US007896152B1

(12) United States Patent
Bruhl

(10) Patent No.: US 7,896,152 B1
(45) Date of Patent: Mar. 1, 2011

(54) CLOTHING, JEWELRY AND ACCESSORIES COORDINATOR

(76) Inventor: Sheila A. Bruhl, Naylor, GA (US)

( * ) Notice: Subject to any disclaimer, the term of this patent is extended or adjusted under 35 U.S.C. 154(b) by 0 days.

(21) Appl. No.: 12/587,191

(22) Filed: Oct. 2, 2009

(51) Int. Cl.
*B65D 73/00* (2006.01)

(52) U.S. Cl. ..... 206/6.1; 206/286; 206/806; 383/9

(58) Field of Classification Search ..... 206/6.1, 206/286, 288–289, 806, 553; 383/9, 17, 383/22–23, 26, 64, 66, 38–40
See application file for complete search history.

(56) References Cited

U.S. PATENT DOCUMENTS 1,513,514 A * 10/1924 London ..... 383/39
2,710,638 A * 6/1955 Ford ..... 383/23
3,139,133 A * 6/1964 Spector ..... 190/111
3,276,601 A 10/1966 Haggerty
4,401,219 A 8/1983 Mink
4,852,783 A * 8/1989 Bryden et al. ..... 224/684
4,859,084 A * 8/1989 Kaumeyer ..... 383/39
5,007,143 A 4/1991 Herington et al.
5,010,627 A 4/1991 Herington et al.
5,063,644 A 11/1991 Herington, Jr.
5,065,864 A * 11/1991 Schmitt ..... 206/278
5,152,613 A 10/1992 Herington, Jr.
5,165,544 A * 11/1992 Gusenoff et al. ..... 206/308.3
5,209,344 A * 5/1993 Smith ..... 206/6.1
5,363,953 A 11/1994 Carter
5,427,230 A 6/1995 Mattox
5,509,588 A * 4/1996 Kimball ..... 223/98
5,526,968 A 6/1996 Larson
5,664,299 A 9/1997 Porchia et al.
5,722,128 A 3/1998 Toney et al.
5,836,056 A 11/1998 Porchia et al.
5,950,285 A 9/1999 Porchia et al.
6,220,436 B1 * 4/2001 Chung ..... 206/424
6,328,469 B1 12/2001 Banco
6,808,064 B1 10/2004 Fanning
6,929,127 B1 * 8/2005 Delk, Sr. ..... 206/449
7,263,748 B2 9/2007 Blythe
7,267,856 B2 9/2007 Patel
2009/0257685 A1 * 10/2009 Matias ..... 383/38

* cited by examiner

*Primary Examiner* — J. Gregory Pickett
*Assistant Examiner* — Robert Poon
(74) *Attorney, Agent, or Firm* — John P. Sinnott; Langdale Vallotton, LLP

(57) ABSTRACT

The accessories coordinator has three separate, essentially air-tight pockets mounted on a transparent support. Each of the pockets is formed through a supplemental film that is bonded at its pocket edges to the support. The individual pockets are each provided with respective reclosable fasteners that selectively seal or provide access to the accessories stored within the pockets. The entire structure is, moreover, formed from only two polymeric sheets, the support and the supplemental film.

5 Claims, 3 Drawing Sheets

CLOTHING, JEWELRY AND ACCESSORIES COORDINATOR

CROSS-REFERENCES TO RELATED APPLICATIONS

None

FEDERALLY SPONSORED RESEARCH OR DEVELOPMENT

None

NAMES OF PARTNERS TO A JOINT RESEARCH AGREEMENT

None

REFERENCE TO "SEQUENCE LISTING"

None

BACKGROUND OF THE INVENTION

This invention relates to an accessories coordinator that has a transparent support, and, more particularly, to a support that has three separate air-tight compartments, the compartments each holding jewelry and other garment accessories and each provided with respective individual closures with a hole formed in the support for engaging the shank on a clothes hanger hook in order to suspend the support from the hook, and the like.

Triangular shoulder and neckline covers for garments that have front and rear layers which enclose the upper portion of a garment have been proposed. Pockets are attached to the front and rear layers of these covers, a pair of these pockets being mounted on the outer surface of the front layer and opened and closed through a commonly shared zipper. There is, however, only one pocket with a zipper closure on the outer surface of the rear layer.

These covers nevertheless fail to satisfy a number of important needs. Illustratively, the double layers and the associated pockets are expensive and difficult to manufacture. Access to the pockets on opposite sides of the triangular covers is quite awkward. In a crowded closet, for example, to remove or even to see the accessories stored in the pockets on opposite sides of the cover usually requires not only pushing and shoving the other garments hanging in the closet out of the way but also removing the selected garment from its place of storage in order to see the contents in all of the pockets on both sides of the garment. The protective value of these triangular neckline covers, moreover, also is questionable.

Further in this regard, relying on a single zipper for opening two separate pockets is quite clumsy because both pockets are likely to be opened, when access only to one of the pockets is needed. In this circumstance accidental spillage of the extra pocket contents can lead to loss or damage to contents falling from the unnecessarily opened pocket. Also, exposing pocket contents to the atmosphere, or relying on pocket closures that are not suitably air-tight can lead to undesirable discoloration or oxidation of the pocket contents.

Consequently, there is a need for an improved clothing coordinator that overcomes the deficiencies in the prior art.

BRIEF SUMMARY OF THE INVENTION

These and other disadvantages of the prior art are largely resolved through the practice of the invention.

Illustratively, a flexible plastic support formed from a single transparent sheet, has a reinforced hole at one end for engaging the shank portion of a clothing hanger hook. Arranged on the support is a supplemental film from which at least three separate, generally transparent pockets are formed. Each of these pockets have separate closure means for individually sealing the respective pockets. Preferably, the pocket closures each form seals that are sufficiently air-tight to prevent jewelry, dress accoutrements and other garment furnishings from discoloration, loss in luster or the like through oxidation or contact with the atmosphere. The single sheet support structure offers the additional benefit of enabling the full contents of all of the pockets to be inspected without removing the garment from storage. Manufacture of the coordinator also is significantly improved because only two sheets of material are required to form the three separate pockets—the support and a supplemental film.

For a more detailed appreciation of this invention, attention is invited to the following description of a preferred embodiment of the invention when taken with the figures of the drawing. The scope of the invention, however, is limited only through the claims appended hereto.

DETAILED DESCRIPTION OF A PREFERRED EMBODIMENT OF THE INVENTION

The foregoing and other disadvantages of the prior art are overcome, largely, through the practice of the invention.

Figure 1:
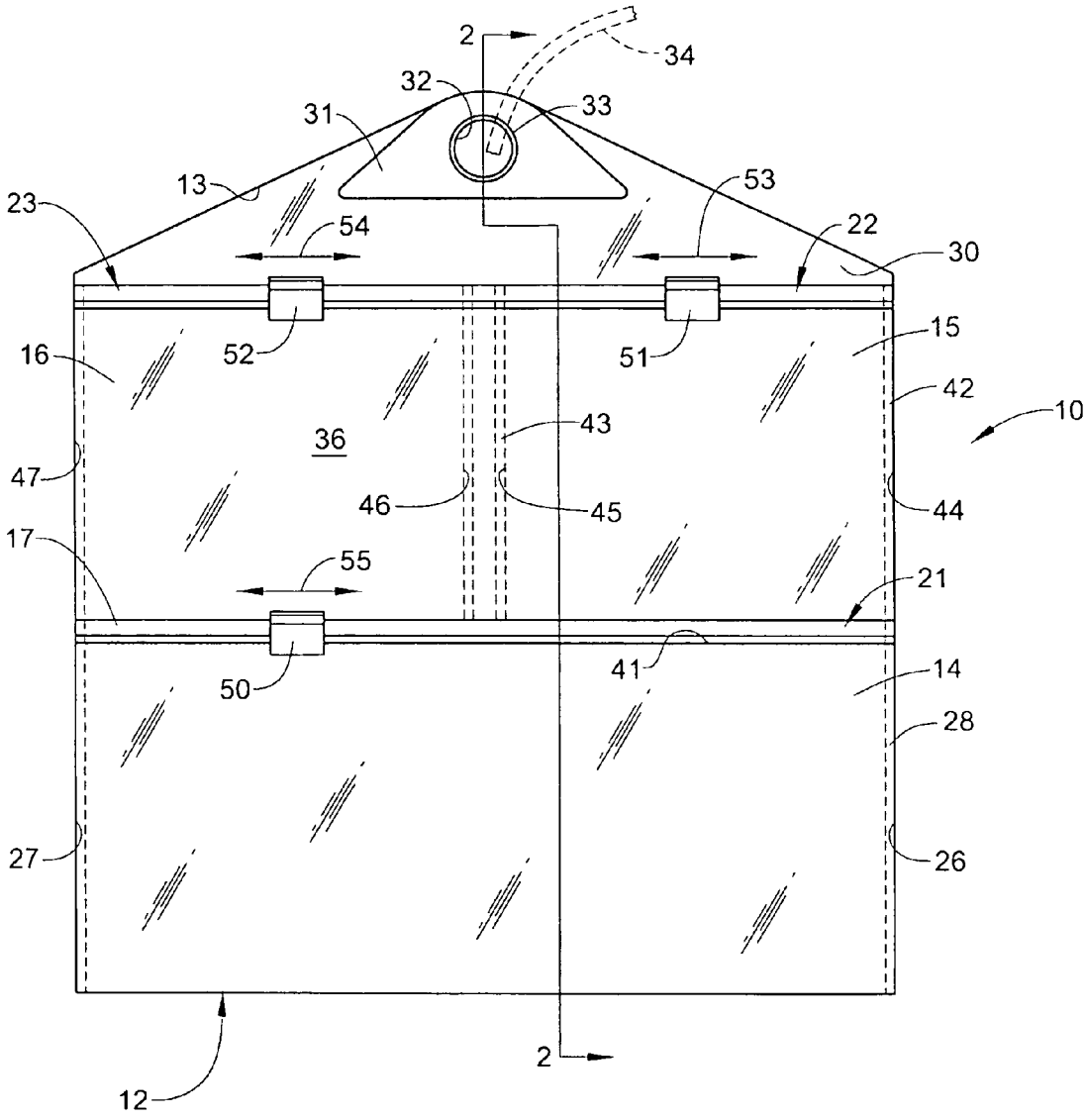
FIG. 1 is a front elevation of a typical embodiment of the invention.
Figure 2:
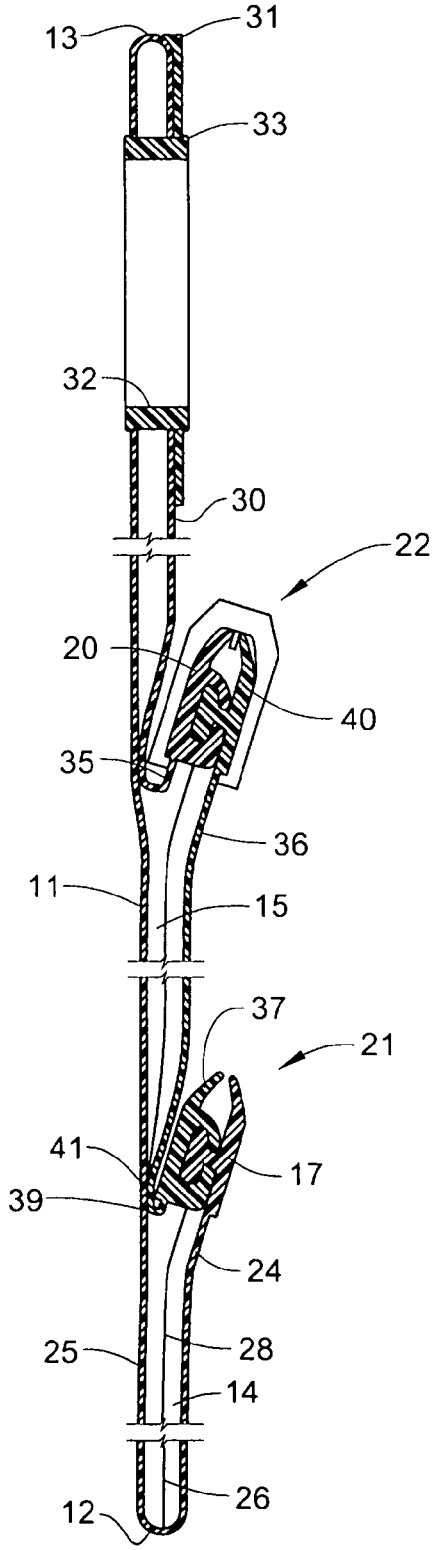
FIG. 2 is a side view in full section of this invention, taken along the line 2-2 of FIG. 1, looking in the direction of the arrows.

For example, FIG. 1 shows an accessories coordinator 10 that has, best shown in FIG. 2, a transparent support 11 formed from a single sheet of flexible plastic e.g. a polymer. The support 11 has folds 12, 13 toward opposite sides of the sheet 11 for forming pockets 15 and, as shown in FIG. 1, to form pocket 16. The support 11, moreover, has formed at each of its respective folded ends tracks 17, 20 (FIG. 2) for associated reclosable fasteners 21, 22 and, as illustrated in FIG. 1, 23. In accordance with a feature of the invention the reclosable fasteners 21, 22, 23 establish suitably air-tight seals for each of the respective pockets 14, 15 and 16 with which the individual fasteners are associated. Reclosable fasteners of the types described in J. S. Blythe U.S. Pat. No. 7,263,748 granted Sep. 4, 2007; H. J. Herrington et al. U.S. Pat. No. 5,010,627 granted Apr. 30, 1991; H. J. Herrington U.S. Pat. No. 5,007,143 granted Apr. 16, 1991; and H. J. Herrington et al. U.S. Pat. No. 5,063,644 granted Nov. 12, 1991 are suitable for the purpose of the invention.

Thus, shown in FIG. 2, folded portion 24 of the support 11 and corresponding portion 25 of the support 11 that is opposite to and overlays the folded portion 24 form the pocket 14.

Returning now to FIG. 1, it can be seen that corresponding edges of the portion 24 and 25 are joined together by means of an adhesive 28 or other appropriate bonding means to establish a single suitably air-tight edge 26. Similarly, air-tight edge 27, opposite to the edge 26 also is formed by bonding or joining together adjoining edges on the folded portion 24 and the corresponding portion 25.

The fold 13 toward the side of the support 11 that is opposite to the fold 12 is doubled over to provide an extra thickness of material 30 (FIG. 2). Preferably, the extra thickness of material is trimmed as shown in FIG. 1 to form a generally triangular shape for the material 30. A further supporting piece 31 is bonded or otherwise appropriately joined to the exposed outer surface of the folded material 30 to provide a hole 32 (FIG. 2) that penetrates not only supporting piece 31 and the folded over material 30, but also the underlaying portion of the support 11. The hole 32, moreover, is lined with a tubular reinforcing collar 33. Best shown in FIG. 1, the reinforcing collar 33 accommodates a shank 34 (shown in broken lines) for securing the accessories coordinator 10 to a hanger for the associated garment (both not shown).

Figure 3:
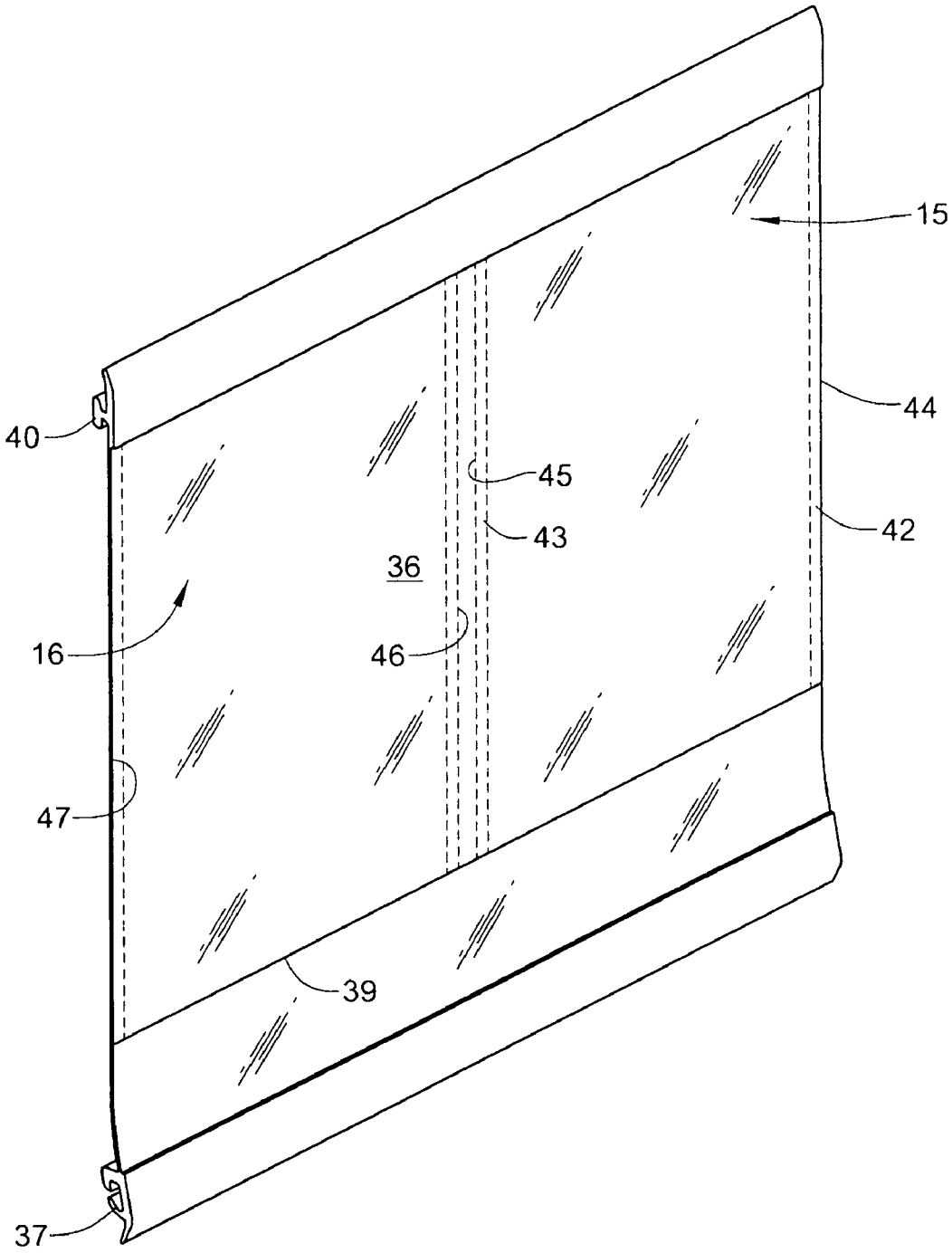
FIG. 3 is a front perspective view of a supplemental film for use in connection with the embodiment of the invention shown in FIGS. 1 and 2.

Turning once more to FIG. 2, it can be seen that end 35 of the folded material 30 terminates in the track 20 for the reclosable fastener 22. As illustrated, the end 35 also is appropriately bonded to a corresponding surface on the support 11 along the entire length of the track 20. The support 11 is a single sheet with the associated folds 12, 13 and the tracks 17, 20. Thus, the entire structure of the support 11 can be formed economically and efficiently through an efficient extrusion or molding technique. In accordance with the invention, a supplemental film 36 (FIG. 3) with tracks 37, 40 also can be produced through an inexpensive extrusion or molding process. As shown in FIG. 2, a portion of the track 37 is bonded 41 or appropriately joined to the underlaying surface of the support 11 along a fold line 39 (FIGS. 2 and 3) that parallels the entire length of the track 17 (FIG. 1). In this way the supplemental film 36 when bonded to the underlaying portion of the support 11 not only forms (as illustrated in broken lines in FIG. 3) the pocket 15, but also the separate pocket 16. Free adjoining edges on the pocket 15 are appropriately joined to form essentially air-tight edges 44, 45. In the same way the pocket 16 is formed through edges 46, 47. Note, however, that the commonly shared set of tracks 20, 40 that provide closures for the pockets 15, 16 are divided by the edges 45, 46 to establish these pockets 15, 16 as completely separate from each other.

The pocket 14, however, is formed only by the support 11 which, as best shown in FIG. 2, if folded over on itself at the fold line 12 to permit the track 17 formed in the end of the support 11 to engage the corresponding and mating track 37 in the end of the supplemental film 36.

In the foregoing manner the accessories coordinator 10 (FIG. 1) appears to have a very complicated structure that nevertheless is manufactured simply, efficiently and inexpensively from only two sheets of transparent (or appropriately colored) polymeric material.

In operation and in accordance with another feature of the invention, each of the corresponding pairs of the tracks 20, 40 (for pockets 15 and 16) and the tracks 17, 37 for the pocket 14 have individual sliders (FIG. 1) 50, 51 and 52. Each of these sliders 50, 51, 52, straddles a respective pair of mating tracks for each of the pockets. As described in more complete detail in J. S. Blythe U.S. Pat. No. 7,263,748 mentioned above, the tracks 20, 40 are aligned with each other as are the tracks 17, 37 for mutual sealing engagement and to form separate closures for the respective pockets 15, 16, and the pocket 14. The individual sliders 50, 51, 52 are moved along their associated sets of the tracks 17, 37 and 20, 40 (FIG. 2) in either of the directions shown by double-headed arrows 53, 54, 55 to open or close the pockets 14, 15 and 16. Thus, the slider 51, of the reclosable fastener 22 is moved in one direction along the tracks 20, 40 to selectively open the pocket 15 for recovering a dress accessory therein (not shown) and, when the slider 51 is moved in the opposite direction, to close the pocket 15 for storing the accessory. To gain access to a dress accessory in the pocket 15 it is only necessary to view the pocket 15 contents without removing the entire garment from the closet in order to identify the accessory in question. By moving the slider 51 along the tracks 20, 40 in the direction that opens the pockets 15 the desired accessory can be removed. As a result, contents in the pocket 16 are not disturbed, spilled or exposed to the atmosphere. Further in this connection, it should be noted that contents of the pocket 14 can be viewed directly from the same side of the accessories coordinator 10 as the contents of the pockets 15 and 16 are viewed without withdrawing the garment with which the coordinator 10 is associated from the closet.

Other embodiments of the invention are possible. For example, the tracks can be opened and closed through an application of digital pressure to aligned pairs of the tracks without the aid of the sliders.

What is claimed is:

1. A clothing accessories coordinator, having pockets for holding the accessories and for mounting on a clothing hanger having a hook with a shank, comprising a support having opposite ends and parallel edges therebetween, a pair of folds formed in said support, each of said folds being spaced from each other toward a respective one of said opposite ends, reclosable fastener tracks on each of a respective one of said opposite ends, a supplemental film having two opposite ends and parallel edges therebetween said supplemental film edges overlaying and joined to said respective support edges, reclosable fastener tracks each on a respective one of said supplemental film ends, and a fold line formed in said supplemental film spaced from one of said reclosable fastener tracks to enable said spaced fastener track to selectively mate with one of said support reclosable fastener tracks and thereby form a closure, said supplemental film fold line and said spaced reclosable fastener tracks establishing areas joined to said support, and said supplemental film being joined to said support to form at least one edge parallel with said support edges and said supplemental film edges to form at least two of the pockets for holding the accessories, each of the pockets having a respective one of said reclosable fastener tracks on one of said supplemental film ends, and a plurality of sliders, each of said sliders straddling a respective pair of said reclosable fastener tracks to form separate and suitably air-tight closures for each of the pockets.

2. A clothing accessories coordinator according to claim 1 wherein another of said support reclosable fastener tracks at said support end is joined to said support and another of said supplemental film reclosable fastener tracks is in alignment with said support and track for selective engagement with said support and track to thereby form another closure.

3. A clothing accessory coordinator according to claim 2 wherein said support has a hole formed therein for engaging the shank of the clothes hanger hook.

4. A clothing accessory coordinator according to claim 3 further comprising a reinforcing collar in said support hole.

5. A clothing accessories coordinator having pockets for holding the accessories and for mounting on a clothing hanger having a hook with a shank, comprising a support having opposite ends and parallel edges therebetween, a pair of folds formed in said support, each of said folds being spaced from each other toward a respective one of said opposite ends, reclosable fastener tracks formed in each of said opposite ends, a supplemental film having two opposite ends and parallel edges therebetween, said supplemental film edges overlaying and joined to said respective support edges, reclosable fastener tracks each formed in a respective one of said supplemental film ends, and a fold line formed in said supplemental film spaced from one of said reclosable fastener tracks to enable said spaced fastener track to selectively mate with one of said support reclosable fasteners tracks, said supplemental film fold line and spaced reclosable fastener track establishing an area joined to said support to form at least one edge parallel with said support edges and said supplemental film edges to form at least two of the pockets for holding the accessories, another of said support reclosable fastener tracks at said support end is joined to said support, another of said supplemental film reclosable fastener tracks in alignment with said support end track for selective engagement with said support end track, a plurality of sliders, each of said sliders straddling a respective pair of said reclosable fastener tracks to form separate and suitably air-tight closures for each of the pockets associated with an individual one of said sliders and said pair of reclosable fastener tracks straddled thereby, said support having a hole formed therein for engaging the shank of the clothes hanger hook, and a reinforcing collar in said support hole.

* * * * *